United States Patent [19]

Gartzmuller

[11] Patent Number: 4,807,514

[45] Date of Patent: Feb. 28, 1989

[54] DIFFERENTIAL HYDRAULIC JACK WITH DAMPING SYSTEM FOR THE CONTROL OF ELECTRIC CIRCUIT-BREAKERS

[76] Inventor: Claude A. Gartzmuller, 30, avenue Georges Mandel, 75116 Paris, France

[21] Appl. No.: 177,675

[22] Filed: Apr. 4, 1988

[30] Foreign Application Priority Data

Apr. 13, 1987 [FR] France ..... 87 05198

[51] Int. Cl.[4] ..... F15B 15/22; F15B 15/17

[52] U.S. Cl. ..... 91/25; 91/417 R; 91/235; 91/321; 91/394; 91/396; 92/85 R; 92/85 B; 200/82 B; 277/209; 277/236

[58] Field of Search ..... 91/394, 395, 396, 417 R, 91/25, 26, 47, 235, 321; 92/85 A, 85 R, 85 B, 86.5; 200/82 B, 82 C, 82 R; 277/173, 209, 207 R, 236; 254/93 R

[56] References Cited

U.S. PATENT DOCUMENTS

| | | | |
|---|---|---|---|
| 4,026,523 | 5/1977 | Gratzmuller | 91/396 |
| 4,065,112 | 12/1977 | Leskovec | 254/93 R |
| 4,289,264 | 9/1981 | Rawlins | 277/173 |
| 4,296,675 | 10/1981 | Gies | 91/26 |

FOREIGN PATENT DOCUMENTS

| | | | |
|---|---|---|---|
| 0004948 | 10/1979 | European Pat. Off. | 91/394 |
| 0068495 | 1/1983 | European Pat. Off. | 91/396 |
| 2027395 | 12/1971 | Fed. Rep. of Germany | 91/26 |
| 2835063 | 2/1980 | Fed. Rep. of Germany | 91/417 R |
| 0083705 | 5/1982 | Japan | 91/394 |
| 0195964 | 12/1982 | Japan | 277/236 |
| 0103618 | 6/1958 | Netherlands | 91/417 R |
| 998753 | 7/1965 | United Kingdom | 91/26 |
| 2095753 | 10/1982 | United Kingdom | 91/396 |

*Primary Examiner*—Robert E. Garrett
*Assistant Examiner*—Thomas Denion
*Attorney, Agent, or Firm*—Max Fogiel

[57] ABSTRACT

A differential hydraulic jack with a damping system for the control of electric circuit-breakers is provided with a floating ring which produces a damping action at the end of travel and is also provided with a damping extension stud which forms part of the jack piston and penetrates into the damping ring. No provision is made on the jack piston for any packing ring forming a seal with the jack cylinder. The damping ring carries two projecting lips constituting a double valve which forms a leak-tight seal with the bottom face of the jack piston and the internal face of the cylinder end. At the end of the travel of the piston, the damping ring forms a double sealing valve for shutting-off the supply/drain orifice of the jack.

10 Claims, 3 Drawing Sheets

FIG_2
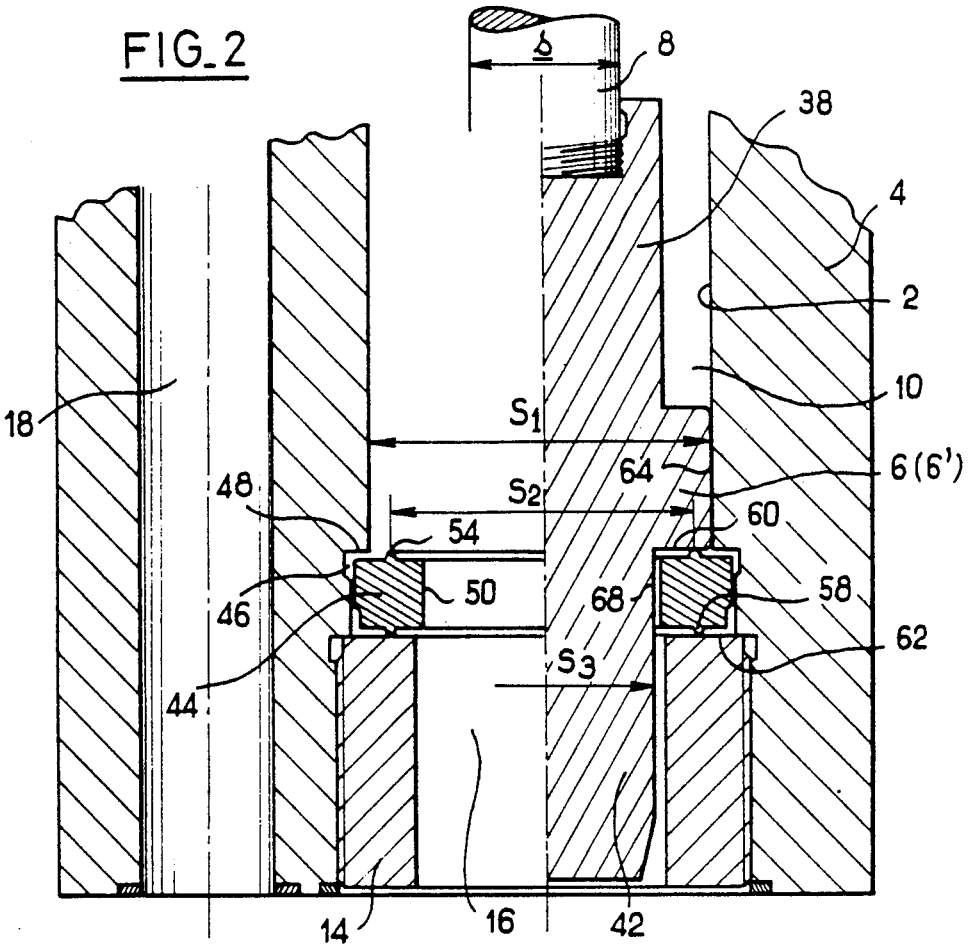
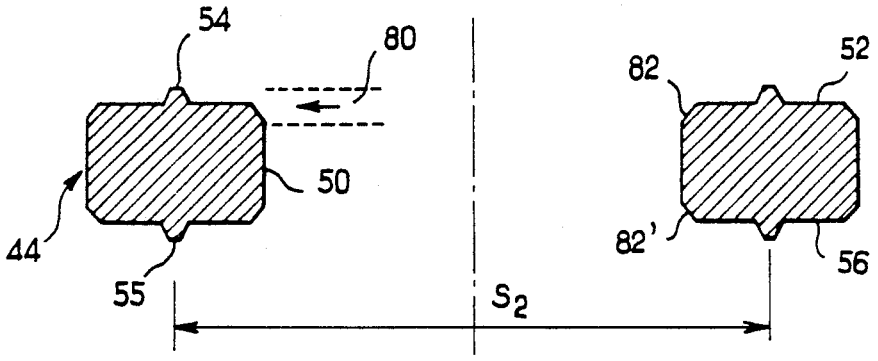
FIG_3

DIFFERENTIAL HYDRAULIC JACK WITH DAMPING SYSTEM FOR THE CONTROL OF ELECTRIC CIRCUIT-BREAKERS

BACKGROUND OF THE INVENTION

1. Field of the Invention

The present invention relates to a differential hydraulic jack for the control of electric circuit-breakers, of the type in which the annular chamber of the jack as defined by the internal surface of the jack cylinder and by the external surface of the emergent piston-rod is continuously connected to a highpressure hydraulic fluid source.

2. Description of the Prior Art

The emergent rod of the hydraulic jack is coupled to the moving contact of the circuit-breaker and a supply/drain orifice formed in the bottom end of the main chamber of the jack can be selectively connected to said high-pressure source ("supply" position) so as to exert an outward thrust on the piston or else to a lowpressure tank ("drain" position) in order to allow the piston to return to its initial position under the action of the high pressure P maintained within the annular chamber.

The first operation causes outward displacement of the piston-rod and moves the circuit-breaker to the engaged or closed position whilst the second operation causes inward displacement of the piston-rod into the cylinder and moves the circuit-breaker to the disengaged or open position.

Hydraulic circuit-breaker control systems of the differential jack type considered in the foregoing are well-known and have been described for example in French patent No. 2,317,532 (or in U.S. Pat. No. 4,026,523).

The design of differential jacks for this application gives rise to constructional difficulties, in particular by reason of the fact that they have to guarantee permanent and absolute leak-tightness over very long periods of time despite very high hydraulic-fluid service pressures P of the order of 300 to 400 bar.

As shown in the prior patent cited earlier, these jacks must therefore be provided with a first packing seal at the point of emergence of the piston-rod through the bottom end of the cylinder and with a second packing seal on the piston.

This second packing seal has to withstand severe operating conditions and is therefore difficult to construct. If it is required to provide perfect leak-tightness, this seal should preferably be of the "spring-loaded packing" type.

In French patent Application No. 87.04.134 filed on Mar. 25th, 1987 in the name of the same inventor, it was shown that, in the differential jack described therein, the piston seal could be dispensed with by combining the piston with a check-valve for shutting-off the supply/drain orifice of the jack at the end of the tripping stroke of said jack.

In the construction of hydraulic jacks for the control of electric circuit-breakers, a further difficulty arises from the need to ensure highly effective damping of the ends of travel of the piston. In fact, since the movements of travel or strokes of the piston necessarily take place during a very short time interval of the order of a few hundredths of a second, operations are very abrupt and steps must accordingly be taken to slow-down or damp the motion of the piston at the ends of travel. This problem is aggravated by the fact that, in this application, only a very short distance (of the order of 20 to 50 mm) is available for the damping operation.

In known types of damping systems for hydraulic jacks, a floating ring is mounted in the end of the jack cylinder. Within this floating ring is engaged a substantially frusto-conical extension or damping stud carried by the piston. At the end of the piston stroke, the cross-sectional area of the annular passage located between the internal surface of the damping ring and the aforesaid extension of the piston progressively decreases, thus producing a progressive wiredrawing or throttling action on the oil contained in the jack chamber between the piston and the cylinder end which carries the damping ring. The oil-wiredrawing action just mentioned has the effect of damping the end of travel of the piston.

One example of a damping floating ring for a hydraulic jack is given in British patent No. 998,753 to Parker Hannifin and, more particularly for the specific application to the control of electric circuit-breakers, in French patent No. 2,317,532 cited earlier.

Known damping systems of the floating ring type provide satisfactory operation when they are applied to hydraulic jacks of conventional design or in other words to jacks in which the piston is fitted with a packing seal. However, precautions must be taken to ensure that the very high overpressures which appear within the damping or "dashpot" chambers are not transmitted to the packing rings of the jack piston since these latter would otherwise become rapidly unserviceable.

This complicates the construction of jacks to an even greater extent, particularly if it is desired to achieve practically perfect reliability in the control of electric circuit-breakers and very long service life without maintenance.

However, these known damping systems of the floating ring type would be inapplicable to differential jacks in which the piston is not provided with a packing ring since they would fail to ensure leak-tight closure of the supply/drain orifice of the main jack chamber at the end of the tripping stroke of the jack. This would result in permanent oil leakage and therefore in permanent oil consumption throughout all periods during which the circuit-breaker is in the open position, which is an unacceptable situation.

The object of the present invention is to overcome these disadvantages and to permit the construction of a differential jack with a ring-type damping system which is of simple design and offers higher reliability of operation than in the past. The invention applies to a jack of the type described in French patent No. 87.04.134 cited earlier, namely in which the piston is combined with a check-valve for shutting-off the supply/drain orifice of the main jack chamber, the closure member of said check-valve being positively actuated by the piston so as to close said orifice at the end of the tripping stroke of said piston, and in which the piston is not provided with any packing ring.

SUMMARY OF THE INVENTION

In accordance with the invention, the shutoff check-valve is constituted by a damping ring which is floatably mounted in the end of the jack cylinder and surrounds the supply/drain orifice, said damping ring being provided with a substantially cylindrical internal surface with which a substantially conical damping extension stud carried by the bottom face of the piston is adapted to cooperate in order to produce an oil-wiredrawing effect between said internal surface of the damping ring and said extension stud.

Said floating ring is adapted to carry on its top annular surface a first projecting circular lip against which the bottom face of the piston is applied in leak-tight manner at the end of the tripping stroke and is adapted to carry on its bottom annular surface a second projecting circular lip which is applied in leaktight manner against the bottom end of the jack cylinder around the supply/drain orifice when a downward thrust is exerted on the damping ring by the piston at the end of the tripping stroke.

The floating ring thus forms a double sealing valve on the one hand between the piston and the damping ring and on the other hand between the ring and the cylinder end.

The single-piece combination of a floating ring which forms both a damping ring and a doublesealing ring-valve accordingly reduces the number of component parts of the jack, thus achieving lower cost and higher reliability.

BRIEF DESCRIPTION OF THE DRAWINGS

FIG. 2 is a fragmentary view to a larger scale showing the lower portion of FIG. 1.

FIG. 3 is a diametral sectional view of the damping ring-valve.

DESCRIPTION OF THE PREFERRED EMBODIMENTS

Figure 1:
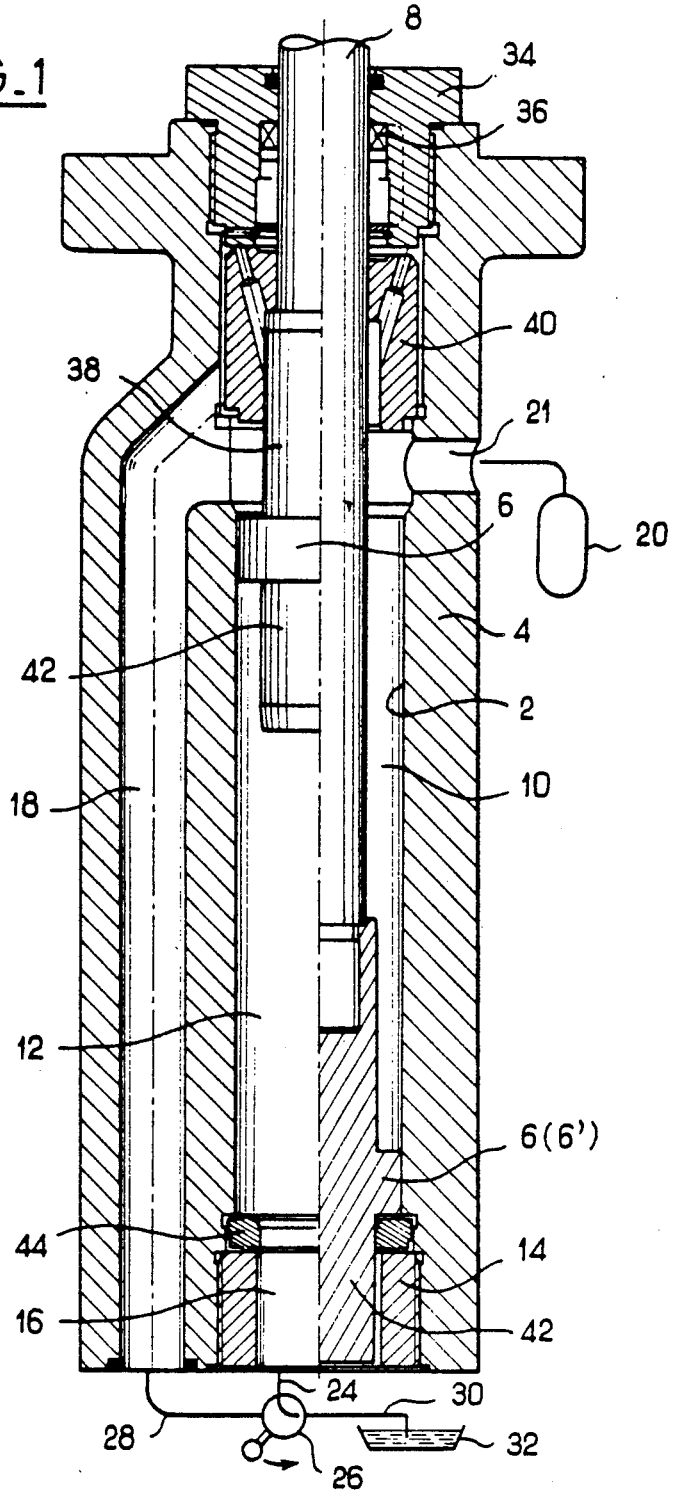
FIG. 1 is an axial sectional view of a jack in accordance with one embodiment of the invention.

The differential jack illustrated in FIG. 1 is of the type described in French patent Application No. 87.04.134 cited earlier.

It suffices to indicate here that this jack has a cylinder 2 which is preferably formed in one piece with a casting 4, there being slidably mounted within said cylinder 2 a piston 6 which is not provided with a packing ring. The rod of the piston 6 is coupled to the moving contact of an electric circuit-breaker (not shown in the drawings).

In the left half of FIG. 1, the piston 6 is shown in its top end-of-travel position corresponding to the closed condition of the circuit-breaker. In the right half of FIG. 1, said piston is shown in its bottom end-of-travel position corresponding to the "tripped" or open condition of the circuit-breaker, this position being designated by the reference 6'.

The piston 6 divides the internal volume of the cylinder 2 into an annular chamber 10 (located above the piston) and a main chamber 12 (located beneath the piston). The bottom of the main chamber or cylinder end is constituted by a screw-in end-plug 14 at the center of which is formed a supply/drain orifice 16.

The annular chamber 10 is put into permanent communication with an oleopneumatic accumulator 20 which is connected to an orifice 21 of the cylinder.

The supply/drain orifice 16 can be selectively put into communication by means of a three-way valve 26, either with the accumulator 20 ("supply" position) via ducts 18-28-24 or with a low-pressure reservoir 32 ("drain" position) via ducts 24-30.

It is worthy of note that the duct 18 is a large-section duct preferably cast in one piece with the cylinder block 4 and having the function of transferring oil at a high flow rate between the two jack chambers 10 and 12.

The emergent piston rod 8 traverses the top end-plug 34 through a packing gland 36.

In accordance with conventional practice, and as described in the above-cited French patent No. 2,317,532 (or U.S. Pat. No. 4,026,523), the piston 6 is adapted to carry first and second male damping members having a substantially or partially frustoconical shape or having stepped sections. The first damping member 38 above the piston 6 is adapted to cooperate with a damping ring 40 of a design similar to the ring described in the patent cited earlier for the purpose of damping the top end-of-travel of the piston 6.

The second damping member 42 which constitutes an extension of the piston 6 beneath this latter is adapted to cooperate with the ring 44 which forms both a damping device and a double sealing valve in accordance with the damping system of the present invention.

It must be recalled at this juncture that, in a differential jack of the type just described, the absence of a packing ring on the piston 6 results in continuous oil leakage between the external cylindrical surface of the piston and the opposite surface of the cylinder 2 when a pressure difference exists on the two faces of the piston.

At the end of the tripping stroke which corresponds to the bottom position of the piston, the piston itself or a valve carried by said piston produces and maintains leak-tight closure of the supply/drain orifice 16 which is then at low pressure. Any high-pressure oil leakage from the jack cylinder via said orifice is thus prevented as long as the piston remains in the bottom position.

With reference to FIG. 2 which is an enlarged view of the lower portion of FIG. 1, the damping system in accordance with the invention includes the ring 44 which is floatably mounted within a recess 46 in which it is retained by the top annular face of the end-plug 14 and by an annular shoulder 48 cut in the cylinder 2. A clearance space is provided within the recess for ensuring that the damping ring is capable of radial displacement in order to be freely centered on the damping extension 42 of the piston 6. This floating arrangement of a damping ring is well-known and makes it possible to obtain a "wiredrawn" or throttled annular flow of oil between the internal surface 50 of the damping ring 44 (see FIG. 3) and the extension 42 of the piston 6, thus producing a damping action which is reproducible.

As shown in FIGS. 2 and 3, the damping ring is provided on its top annular surface 52 with a first projecting circular lip 54 and on its bottom surface 56 with a second identical lip 58.

The upper lip 54 forms a leak-tight seal in cooperation with the bottom annular face 60 of the piston 6 and in the end-of-travel position of the piston whilst the lower lip 58 forms a second leak-tight seal in cooperation with the top annular face 62 of the end-plug 14. Thus the damping ring 44 performs the function of a double valve which ensures leak-tight closure of the supply/drain orifice 16 when the piston is in its end-of-travel position whereas the same ring constitutes the end-of-travel stop of the piston after damping.

Preferably, the damping ring 44 is formed of metal having a higher degree of hardness than the piston 6 and the end-plug 14 against which the lips 54–58 are applied. By virtue of the fact that the piston itself as well as the piston rod 8 are guided at the most distant locations in the bottom position of said piston, good parallel alignment is obtained between the bottom annular surface 60 of the piston 6 and the top of the circular lip 54, thus ensuring a high standard of leaktightness. tightness.

In FIG. 2, there are indicated the surface areas (or cross-sectional areas) $S_1$, $S_2$ and s respectively of the piston 6, of the lips 54–58 and of the emergent piston rod 8.

This figure shows the tripping end-of-travel position of the piston 6 which is abuttingly applied against the damping ring 44. In this position, the supply/drain orifice is in the drain condition or in other words at a low pressure $P_0$ which is substantially equal to atmospheric pressure whilst the continuous highpressure $P_1$ supplied by the accumulator 20 (shown in FIG. 1) is maintained within the annular chamber 10 of the jack.

With the type of jack to which the invention applies, in which the piston is not provided with a packing ring, the oil at the pressure $P_1$ contained in the chamber 10 above the jack leaks between the external cylindrical surface 64 of the piston 6 and the cylinder 2. The pressure $P_1$ is therefore established above and beneath the ring-valve 44 in the external zone of this latter which is limited by the lips 54–58. Said lips form with the opposite surfaces 60–62 a leak-tight barrier to the pressure $P_1$.

In this position, the bearing force applied by the piston 6 on the damping ring is :

$$F_1 = P_1(S_2 - s)$$

In view of the fact that the cross-sectional area $S_2$ is intended to be of the order of 1.5 times the cross-sectional area s of the piston rod, the bearing force $F_1$ is of the order of $0.3(S_2 \times P_1)$.

Since the service pressure $P_1$ in hydraulic circuit-breaker control systems is of the order of 300 to 400 bar and since the cross-sectional area $S_2$ of the ring-valve can be of the order of 10 to 20 $cm^2$ in the most common applications, it is apparent that the continuous closing force exerted on the ring-valve can have a very high value of the order of several tons while ensuring permanent and total leak-tightness, all the more so since the lips 54–58 of hard metal leave their imprint in the metal of lower hardness of the piston 6 and of the end-plug 14.

Figure 4:
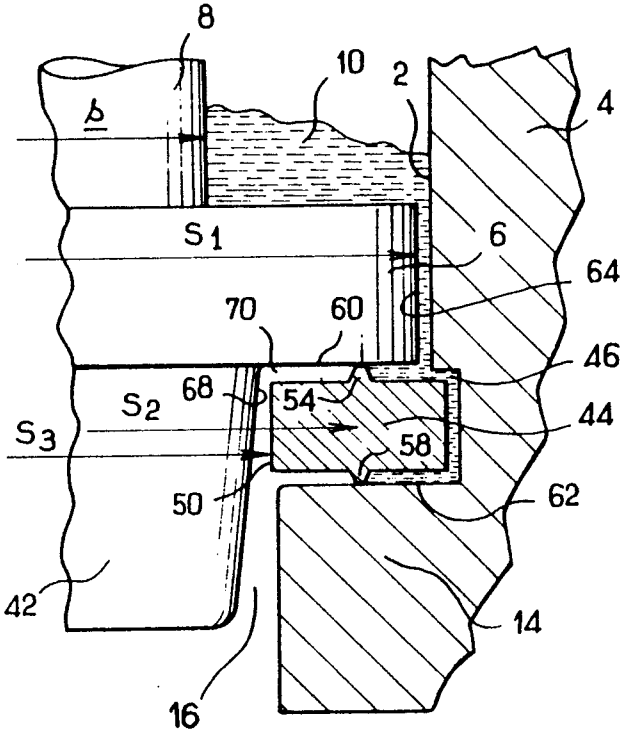
FIG. 4 is a fragmentary sectional view showing the zone of contact of the damping ring with the piston and the cylinder end.

It will be recalled at this point that the last portion of travel of the piston before this latter arrives in abutting contact with the ring 44 is damped by the penetration of the extension 42 of the piston 6 into the ring 44. In FIGS. 2 and 4, there is shown a relatively large clearance space between the internal cylindrical surface 50 of the damping ring 44 and the external surface 68 of the extension 42. Should it be found desirable to obtain a powerful damping action, however, the annular gap between these two surfaces is very small in order to produce efficient oil-wiredrawing. This consequently produces a very high over-pressure or so-called damping overpressure within the main chamber of the jack beneath the piston.

In a conventional jack, this overpressure (several thousand bar) is dangerous for the piston ring or packing which is abruptly subjected to a very high pressure. On the contrary, in a jack in accordance with the invention, this damping overpressure does not present the least hazard since the piston is not fitted with any packing ring.

The jack will now be described with reference to the fragmentary view of FIG. 4. In the position shown, the piston 6 is at the bottom end of travel (end of tripping stroke) and the supply/drain orifice 16 is at the low pressure $P_0$ (drain) whilst the continuous high pressure $P_1$ prevails within the annular chamber of the jack. The piston 6 is applied against the ring-valve 44 with the force $F_1 = P_1(S_2 - s)$ indicated earlier and the pressure $P_1$ within the annular jack chamber 10 is also established above and beneath the ring-valve 44 externally of the lips 54–58 by reason of the nonleaktightness of the piston 6 within the cylinder 2. The entire zone in which the pressure $P_1$ prevails is indicated in FIG. 4 by dashed-line hatchings.

In order to produce a reverse stroke of the jack (closing stroke), the orifice 16 is supplied at the high pressure $P_1$ (supply position shown in FIG. 1: valve 24). The pressure therefore undergoes a rapid change from the value $P_0$ to the value $P_1$ within the orifice 16, within the annular gap between the opposite surfaces 50 and 68 of the ring-valve 44 and the damping extension stud 42, then within the space 70 beneath the piston 6 up to the lip 54. This pressure therefore exerts on the piston 6 an upward thrust $P \times S_2$ which acts in opposition to the downward force $F_1$ and, as soon as it attains a value $P_2$, or so-called unseating pressure, such that:

$$P_2 \times S_2 = P_1(S_2 - s)$$

the piston 6 will then begin its closing stroke.

The "unseating pressure" is therefore :

$$P_2 = P_1(1 - s/S_2)$$

that is, in the preferred case in which $S_2$ is of the order of 1.5 times s, $P_2$ is of the order of 0.33 $P_1$.

It is therefore apparent that free and very rapid operation of the jack may accordingly be initiated since the jack starts-up as soon as the supply pressure attains 33% of the high pressure $P_1$. This is a very important feature in the case of control of electric circuit-breakers in which the response has to be very fast.

Even if the surface area chosen for the lips has a value $S_2$ which is double that of the cross-sectional area s of the emergent piston rod, unseating of the ring-valve takes place in respect of a pressure $P_2$ equal to 50% of the high pressure $P_1$.

It may readily be understood that, after "unseating" or in other words as soon as the lips 54–58 are no longer in leak-tight contact with the opposite surfaces 60–62, the pressure $P_1$ is exerted on the entire surface area $S_1$ of the piston 6 which is subjected to the normal operating force $F_3 = P_1 \cdot S_1 - P_1(S_1 - s) = P_1 19$ s, as in a conventional differential jack.

For certain applications, it is necessary to produce a very powerful damping action at the end of travel, in which case a very small annular gap is provided between the external surface 68 of the damping extension 42 and the opposite cylindrical surface 50 of the damping ring.

In this case, when pressure is restored at the supply/-drain orifice 16, the above-mentioned small annular gap retards the admission of oil under pressure into the space 70 located beneath the piston 6.

In order to increase the speed of response in this case, it is an advantage to provide means for resupplying said space 70.

Figure 5:
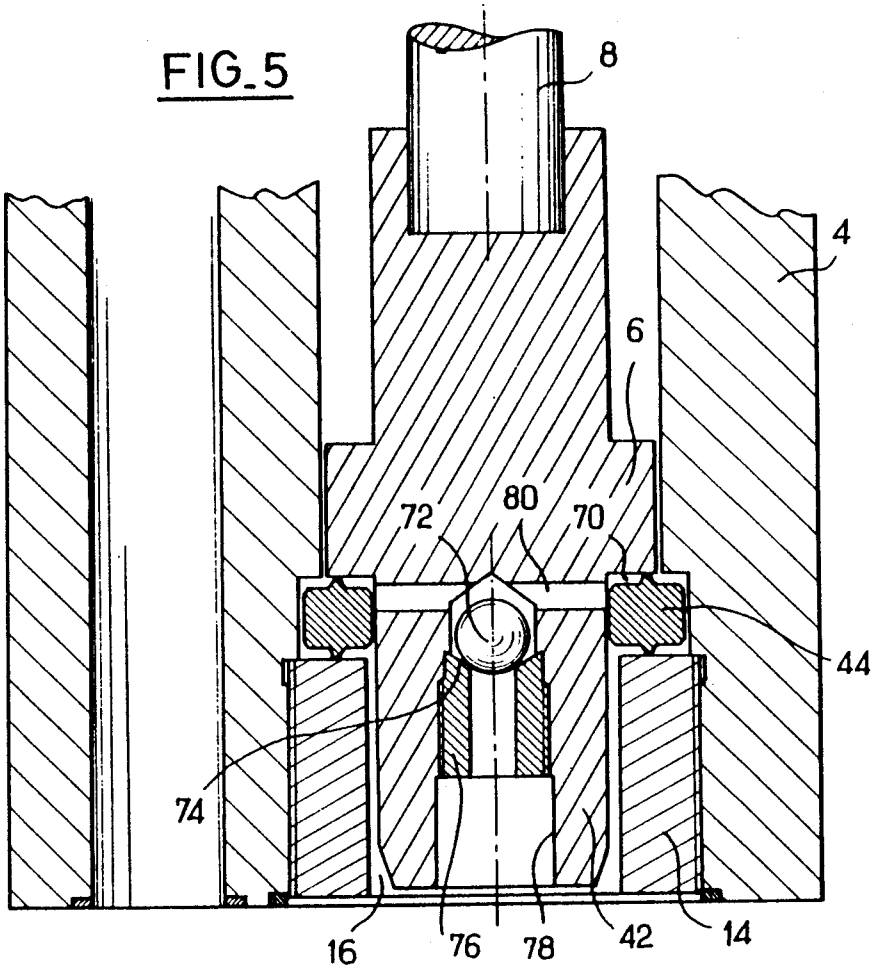
FIG. 5 is a view which is similar to FIG. 2 and shows a preferred embodiment of the invention.

In the embodiment shown in FIG. 5, these resupply means essentially include a non-return valve constituted by a ball 72 and a valve-seat 74, this valve-seat being cut in a cylindrical sleeve 76 screwed into a bore 78 which is drilled in the damping extension stud 42. By means of one or a number of diametral ducts 80, the space located above the ball 72 is caused to communicate with the external surface 68 of the damping extension stud and consequently with the space 70 to be re-supplied.

At the moment of tripping (return of the piston 6 to the bottom position), the damping high pressure produced beneath the piston maintains the non-return valve 72–74 closed by applying the ball 72 on its seat 74, with the result that the oil is permitted to escape only by wiredrawing effect between the extension stud 42 and the damping ring 44.

At the moment of repressurization of the supply/-drain orifice 16, the oil under pressure lifts the ball 72 and flows through the diametral ducts 80 into the space 70 beneath the piston 6 in which the pressure $P_2$ is established, that is to say the unseating pressure referred-to earlier.

A point worthy of note is that, when the jack is in the bottom position (tripped or "open" condition of the circuit-breaker), the non-return valve 72–74 does not need to be leak-tight since the same low pressure $P_0$ prevails within the space 70 and within the supply/-drain orifice (which is in this case connected to the drain tank). In consequence, the non-return valve is not subjected to any stringent constructional requirement.

In order to facilitate re-supply of oil from the ducts 80 to the space 70, provision can be made for a counter-bore in the internal cylindrical surface 50 of the damping ring 44 at the level of said ducts 80. However, it is preferable to form a chamfered edge 82 (see FIG. 3) on the top side of the damping ring 44 substantially opposite to the outlet of the duct 80 (as shown in dashed lines in FIG. 3).

In order to avoid any error of assembly, it is also an advantage to provide another chamfered edge 82' on the bottom side of the ring 44 so that this latter may consequently be mounted either way up.

External chamfers 84–84' can be also be provided so as to forestall any danger of jamming of the floating ring within its housing.

Similarly, it is more simple to ensure that the diameter of the circular lips 54 and 58 (therefore the cross-sectional area $S_2$ of said lips) are identical, thus permitting assembly with either side uppermost. However, it would not constitute any departure from the scope of the invention to provide lips 54 and 58 having different cross-sections.

In a jack in accordance with the invention, the cross-sectional area $S_3$ of the damping extension stud 42 is smaller than the cross-sectional area $S_2$ of the ring-valve lips 54–58 but larger than the crosssectional area s of the emergent piston rod by a quantity such that the difference in cross-sectional area $S_3-s$ is sufficient to ensure that the piston 6 reliably travels to the end of its downward stroke (tripping stroke) in spite of leakages between the piston and the cylinder when performing low-speed operating tests at a low rate of flow. Should the value $S_2$ chosen for the ring-valve surface area be of the order of 50% higher than the cross-sectional area s of the emergent piston rod, the value $S_3$ chosen for the damping extension stud will be of the order of 30% higher than the cross-sectional area s of the emergent rod.

What is claimed is:

1. A differential hydraulic jack for oleopneumatic control of electric circuit-breakers, comprising a cylinder, a piston and an emergent piston-rod which define within the cylinder an annular chamber on one side of the piston and a main chamber on the other side of the piston, said emergent piston-rod being coupled with the moving contact of the circuit-breaker, said annular chamber being continuously connected to a source of hydraulic fluid under high pressure and said main chamber being provided in the corresponding end of the cylinder with a supply/drain orifice for said chamber, a damping extension stud being carried by said piston on that face which is directed toward the main chamber and being adapted to cooperate with a damping ring floatably mounted around the supply/drain orifice, wherein:

the jack piston is not provided with any packing ring forming a seal with the internal surface of the jack cylinder;

the damping ring constitutes an end-of-travel stop for the jack piston;

said ring is provided with a first annular sealing zone on its radial annular surface which is directed toward the main chamber and with a second annular sealing zone on its opposite radial annular surface, said first and second zones being adapted to form first and second valves providing a seal respectively with the aforesaid piston face and with the cylinder end when the piston is located at its end of travel.

2. A jack according to claim 1, wherein the first and second annular sealing zones are constituted by first and second circular sealing lips which project respectively from the two radial annular faces of the damping ring and form an integral part of said ring.

3. A jack according to claim 2, wherein the damping ring and consequently the lips of said ring are formed of metal having a higher degree of hardness than the metal of the jack piston and the metal of the cylinder end.

4. A jack according to claim 2, wherein the surface area $S_2$ of the lips is larger than the cross-sectional area s of the emergent piston rod and is larger by approximately 50%.

5. A jack according to claim 4, wherein the first lip and the second lip have an identical surface area $S_2$.

6. A jack according to claim 1, wherein means are provided for re-supply of high-pressure fluid to the annular spaces located between the aforesaid piston face and the opposite face of the damping ring.

7. A jack according to claim 6, wherein the resupply means include a non-return valve housed within the damping extension stud of the jack piston and radial ducts pierced in said stud.

8. A jack according to claim 7, wherein the resupply means include a first cut in the internal periphery of the damping ring substantially opposite to the radial ducts.

9. A jack according to claim 8, wherein a second chamfer is cut in the ring symmetrically with the first chamfer so as to permit symmetrical reversal of said damping ring.

10. A jack according to claim 1, wherein the crosssectional area $S_3$ of the damping extension stud is larger than the cross-sectional area s of the emergent piston rod.

* * * * *

UNITED STATES PATENT AND TRADEMARK OFFICE

CERTIFICATE OF CORRECTION

PATENT NO. : 4,807,514

DATED : February 28, 1989

INVENTOR(S) : Claude A. Gratzmuller

It is certified that error appears in the above-identified patent and that said Letters Patent is hereby corrected as shown below:

On The Title Page, the inventor's name should read

-- Claude A. Gratzmuller --.

Signed and Sealed this

Tenth Day of October, 1989

*Attest:*

*Attesting Officer*

DONALD J. QUIGG

*Commissioner of Patents and Trademarks*